US009719381B2

(12) United States Patent
Yoshimoto et al.

(10) Patent No.: US 9,719,381 B2
(45) Date of Patent: Aug. 1, 2017

(54) VALVE GEAR FOR ENGINE

(71) Applicant: SUZUKI MOTOR CORPORATION, Hamamatsu-shi, Shizuoka (JP)

(72) Inventors: Daisuke Yoshimoto, Hamamatsu (JP); Shuichi Yokota, Hamamatsu (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 164 days.

(21) Appl. No.: 14/797,053

(22) Filed: Jul. 10, 2015

(65) Prior Publication Data

US 2016/0010517 A1 Jan. 14, 2016

(30) Foreign Application Priority Data

Jul. 11, 2014 (JP) ..... 2014-143325

(51) Int. Cl.
*F01L 1/34* (2006.01)
*F01L 1/344* (2006.01)
*F01L 1/047* (2006.01)
*F01L 1/46* (2006.01)

(52) U.S. Cl.
CPC ..... *F01L 1/34403* (2013.01); *F01L 1/047* (2013.01); *F01L 1/46* (2013.01)

(58) Field of Classification Search
CPC ..... F01L 1/34403; F01L 1/047; F01L 1/46
USPC ..... 123/90.15, 90.17
See application file for complete search history.

(56) References Cited

FOREIGN PATENT DOCUMENTS

JP 2010-31855 A 2/2010
JP 2013-7293 A 1/2013

*Primary Examiner* — Ching Chang
(74) *Attorney, Agent, or Firm* — Stein IP, LLC

(57) ABSTRACT

A valve gear for an engine, includes: a camshaft phase varying device by which a rotational phase of a camshaft for opening/closing valves of the engine can be changed relatively to that of a crankshaft; and a holder that is provided so that the holder can be removably attached to the camshaft in a state where the holder has held constituent components of the camshaft phase varying device.

10 Claims, 7 Drawing Sheets

VALVE GEAR FOR ENGINE

FIELD OF THE INVENTION

The present invention relates a valve gear for an engine, and particularly relates to a valve gear for an engine including a camshaft phase varying device for varying the rotational phase of a camshaft relative to a crankshaft.

BACKGROUND OF THE INVENTION

Generally a valve gear for opening and closing intake and exhaust valves at timings synchronized with rotation of a crankshaft (that is, at timings when each valve has the same rotational phase as the crankshaft) is placed in an engine. In the engine provided with such a valve gear, however, it has been known that the optimum opening/closing timings of the intake valves and the exhaust valves are, for example, changed in accordance with the running condition of the engine such as the engine speed or the engine load. Recently, it has been therefore proposed an engine including a valve gear provided with a camshaft phase varying device for varying the rotational phase of a camshaft relative to a crankshaft in order to change the opening/closing timings of intake valves and exhaust valves in accordance with the running condition of the engine.

As disclosed in JP-A-2010-31855 or JP-A-2013-7293, such a valve gear for an engine in the background art has a configuration in which a driven member, a guide member, a centrifugal weight and an urging member are installed on a camshaft individually. The driven member cannot be displaced axially relatively to the camshaft but can be displaced rotationally relatively to the camshaft. The guide member is provided on the camshaft rotatably together therewith so that the guide member can be displaced rotationally and axially relatively to the driven member. The centrifugal weight is disposed between the driven member and the guide member. The urging member urges the driven member and the guide member so as to make them close to each other. The centrifugal weight moves radially outward against the urging force of the urging member due to the effect of a centrifugal force caused by rotation of the engine. Thus, the guide member is displaced rotationally and axially relatively to the driven member so as to change the rotational phase of the camshaft relative to a crankshaft and change the opening/closing timings of valves.

SUMMARY OF THE INVENTION

The aforementioned camshaft phase varying device cannot operate satisfactorily when there is a variation in the centrifugal force acting on the centrifugal weight or the frictional force generated between the driven member and the centrifugal weight and between the guide member and the centrifugal weight during the rotation of cams. Therefore, in order that the engine speed at which the opening/closing timings of the valves should be changed over can be kept within a predetermined range, the machining accuracy of each constituent component must be enhanced while the centrifugal weight, the urging member, etc. must be adjusted to perform work to confirm and adjust the engine speed after the constituent components have been installed.

However, in the aforementioned valve gear for an engine in the background art, each constituent component of the camshaft phase varying device must be installed individually as a single body on the camshaft, and the engine speed must be confirmed and adjusted in the state where the constituent components have been installed. It is therefore necessary to perform work to assemble and disassemble the constituent components on the camshaft repeatedly many times or replace each constituent component individually as a single body. Thus, it takes much labor for such a work.

In addition, when each constituent component is replaced individually as a single body, a frictional force or the like between components touching each other may be changed to generate a variation in performance such as engine speed for changeover, durability, reproducibility, etc. Thus, there is another problem that it is difficult to guarantee the performance.

The present invention has been developed to solve the foregoing problems. An object of the invention is to provide a valve gear for an engine capable of easily performing work to confirm and adjust engine speed for changeover or replace constituent components, and easily guaranteeing the performance.

The invention is directed to a valve gear for an engine, comprising: a camshaft phase varying device by which a rotational phase of a camshaft for opening/closing valves of the engine can be changed relatively to that of a crankshaft; and a holder that is provided so that the holder can be removably attached to the camshaft in a state where the holder has held constituent components of the camshaft phase varying device.

In the valve gear for an engine according to the invention, the constituent components of the camshaft phase varying device may comprises: a driven member that cannot be displaced axially relatively to the camshaft but can be displaced rotationally relatively to the camshaft; a guide member that is provided rotatably together with the camshaft so that the guide member can be displaced rotationally and axially relatively to the driven member; a centrifugal weight that is disposed between the driven member and the guide member; and an urging member that urges the driven member and the guide member so as to make the driven member and the guide member close to each other.

When the holder is provided thus, the holder can be installed on the camshaft after the constituent components of the camshaft phase varying device have been held in the holder. Accordingly, work to confirm or adjust operation of each constituent component of the camshaft phase varying device can be performed in a stage in which the holder holding the constituent component has not yet been installed on the camshaft. Such a work can be therefore carried out easily and surely. In addition, if a problem is found in a constituent component as a single body in this stage, the component can be replaced as a single body easily and rapidly. It is possible to prevent a variation from occurring in the performance such as engine speed for changeover, durability, reproducibility, etc. due to a variation in frictional force between components touching each other. Thus, the performance can be guaranteed easily.

Further, in the valve gear for an engine according to the invention, a spline key may be provided in the holder, and the guide member may be held in the holder so that the guide member can move axially along the spline key.

When the spline key is thus formed on the holder different from the camshaft so that the guide member can move axially along the spline key, another material high in abrasion resistance than the material of the camshaft can be used for the spline key. Thus, the durability can be improved.

In the valve gear for an engine according to the invention, the holder may be attached to an axial end of the camshaft so that the holder cannot rotate.

With this configuration, the valve gear or the camshaft phase varying device can have predetermined performance surely.

In the valve gear for an engine according to the invention, an oil passage may be provided inside the camshaft, and an oil supply path to the constituent components of the camshaft phase varying device may be formed in the holder so as to communicate with the oil passage.

In the valve gear for an engine according to the invention, the oil supply path may be formed with a smaller passage sectional area than that of the oil passage and in a position where oil can be supplied to the spline key provided in the holder.

When the oil supply path is thus formed in the holder so as to communicate with the oil passage in the camshaft, engine oil supplied to the camshaft can be stably supplied to required places in the camshaft phase varying device so as to lubricate the camshaft phase varying device. It is therefore possible to operate the camshaft phase varying device stably and it is also possible to improve the abrasion resistance of the constituent components of the camshaft phase varying device.

According to the invention, it is possible to obtain various excellent effects such as an effect that engine speed for changeover at which the timings of opening/closing valves should be changed over can be confirmed and adjusted easily or constituent components can be replaced easily, and an effect that the performance can be guaranteed easily.

DESCRIPTION OF REFERENCE NUMERALS AND SIGNS

Figure 1:
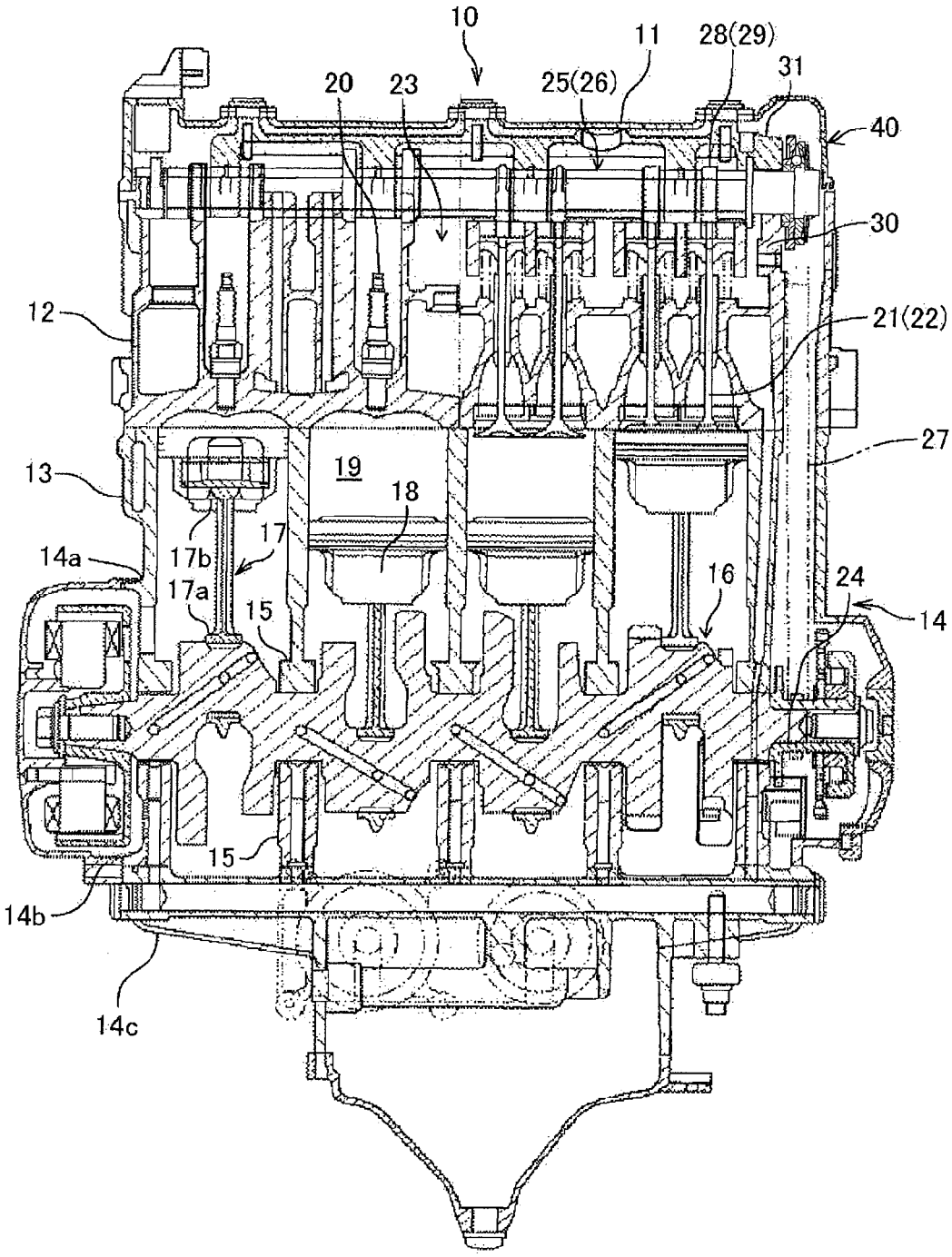
FIG. 1 is a sectional view showing an engine provided with a valve gear according to an embodiment of the invention.

10 engine
16 crankshaft
21 intake valve
23 valve gear
25 intake-side camshaft
34 main oil passage
35 subsidiary oil passage
40 camshaft phase varying device
42 holder
43 driven member
44 guide member
45 centrifugal weight
46 urging member
60 spline key
62 oil supply path

DETAILED DESCRIPTION OF THE INVENTION

A valve gear for an engine according to an embodiment of the invention will be described below with reference to the drawings.

First, an engine provided with a valve gear according to an embodiment of the invention will be described with reference to FIG. 1. FIG. 1 is a sectional view showing the engine provided with the valve gear according to the embodiment of the invention.

An engine 10 is, for example, a 4-cycle parallel four cylinder engine, which is mainly constituted by a head cover 11, a cylinder head 12, a cylinder block 13 and an engine case 14. The engine case 14 is vertically divided into three, including an upper engine case 14*a*, a center engine case 14*b* and a lower engine case 14*c*. The cylinder block 13 is formed integrally with the upper engine case 14*a*.

The cylinder block 13 is disposed not upright but slightly with a forward inclination. Each of bearing portions 15 is formed to be divided into upper and lower parts on the inner sides of mating surfaces between the upper engine case 14*a* and the center engine case 14*b*. A crankshaft 16 extending in a width direction of the engine 10 is rotatably supported on those bearing portions 15.

Large end portions 17*a* of connecting rods 17 are linked with the crankshaft 16, and pistons 18 are linked with small end portions 17*b* of the connecting rods 17. The pistons 18 are received slidably substantially in an up/down direction inside the cylinder block 13. A combustion chamber 19 is formed in a space between the cylinder head 12 and each piston 18. In a central portion of the combustion chamber 18, an ignition plug 20 is screwed down from the outside.

Reciprocating strokes of the pistons 18 are converted into a rotating motion by the crankshaft 16. The rotating motion is transmitted from a not-shown clutch mechanism and a not-shown transmission mechanism to a rear wheel through a drive chain. The clutch mechanism and the transmission mechanism are located in a space formed by the center engine case 14*b* and the lower engine case 14*c*. The rear wheel serves as a driving wheel.

The engine 10 has a valve gear 23 for driving intake valves 21 and exhaust valves 22 disposed inside the cylinder head 12, so as to open and close the intake valves 21 and the exhaust valves 22. The valve gear 23 is of a DOHC (Double OverHead Camshaft) type in the embodiment.

The valve gear 23 has a configuration including the crankshaft 16, an intake-side camshaft 25, an exhaust-side camshaft 26, a camshaft phase varying device 40, and a cam chain 27. A cam drive sprocket 24 is provided in the crank shaft 16 rotatably and integrally therewith. The intake-side camshaft 25 and the exhaust-side camshaft 26 are disposed between the cylinder head 12 and the head cover 11. The camshaft phase varying device 40 is provided at an axial end of at least one of the intake-side camshaft 25 and the exhaust-side camshaft 26. The cam chain 27 is wound around the cam drive sprocket 24 and the camshaft phase varying device 40.

The intake-side camshaft 25 and the exhaust-side camshaft 26 are disposed to extend in the vehicle width direction and to be at a distance from each other in the vehicle length direction and in parallel to each other. Intake cams 28 are formed in the intake-side camshaft 25 integrally therewith, and exhaust cams 29 are formed in the exhaust-side camshaft 26 integrally therewith. The intake-side camshaft 25 and the exhaust-side camshaft 26 are supported rotatably by a bearing portion 30 of the cylinder head 12 and a cam housing 31 attached to the bearing portion 30.

Figure 2:
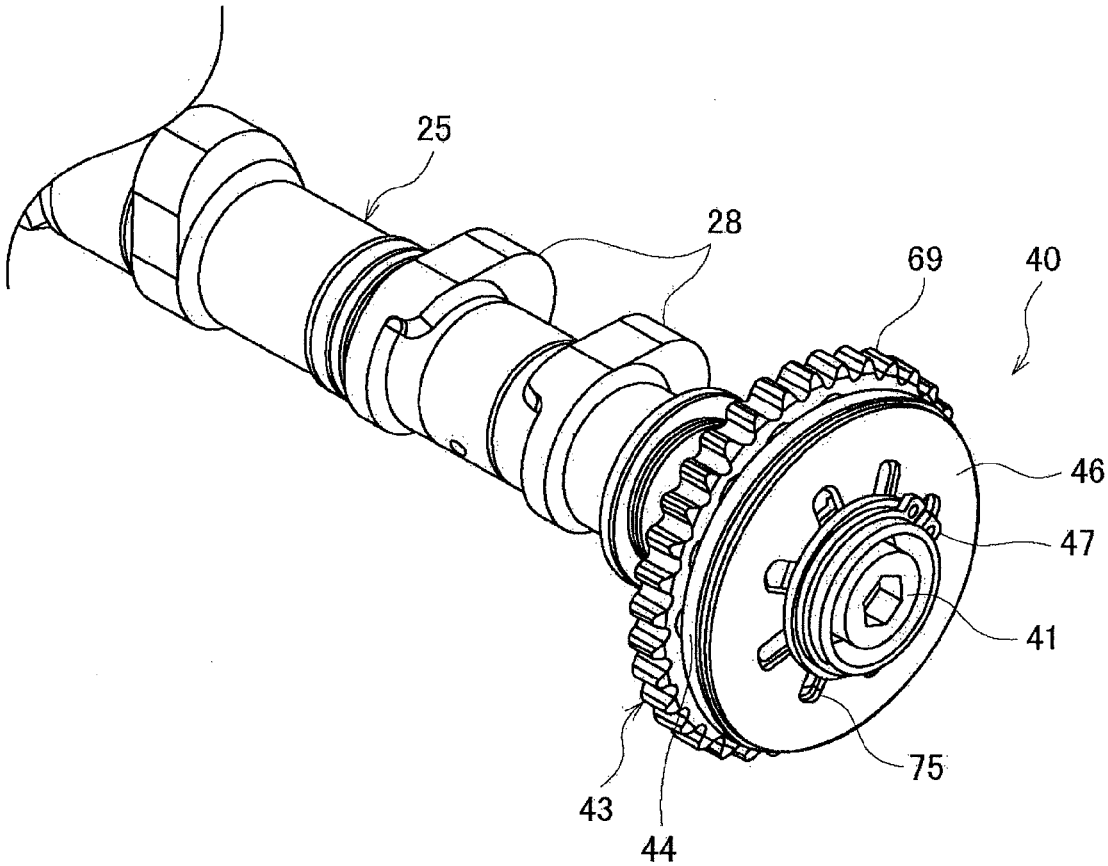
FIG. 2 is a perspective view showing a camshaft phase varying device in the valve gear for the engine according to the embodiment of the invention.
Figure 3:
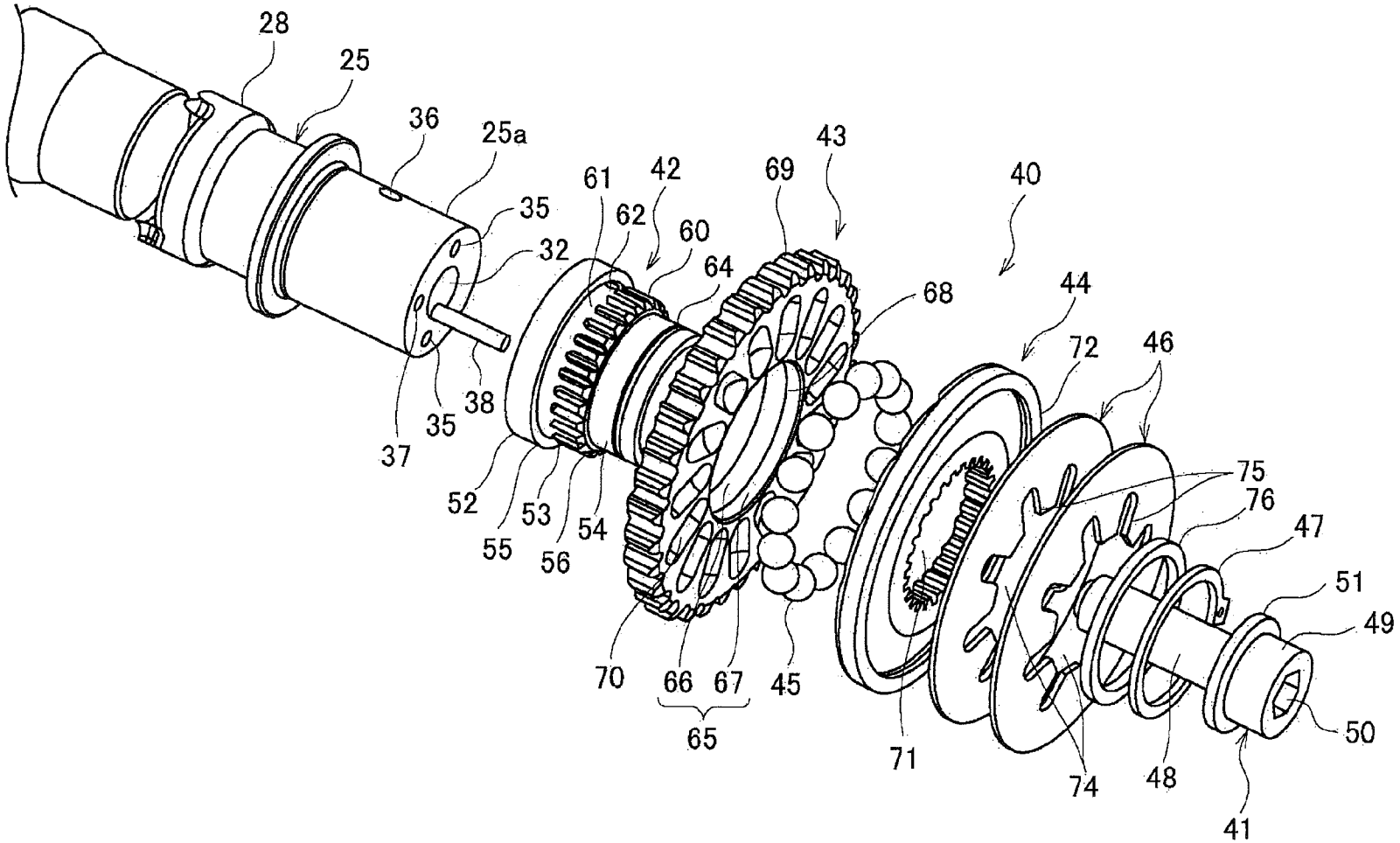
FIG. 3 is an exploded perspective view showing the camshaft phase varying device in the valve gear for the engine according to the embodiment of the invention.
Figure 4:
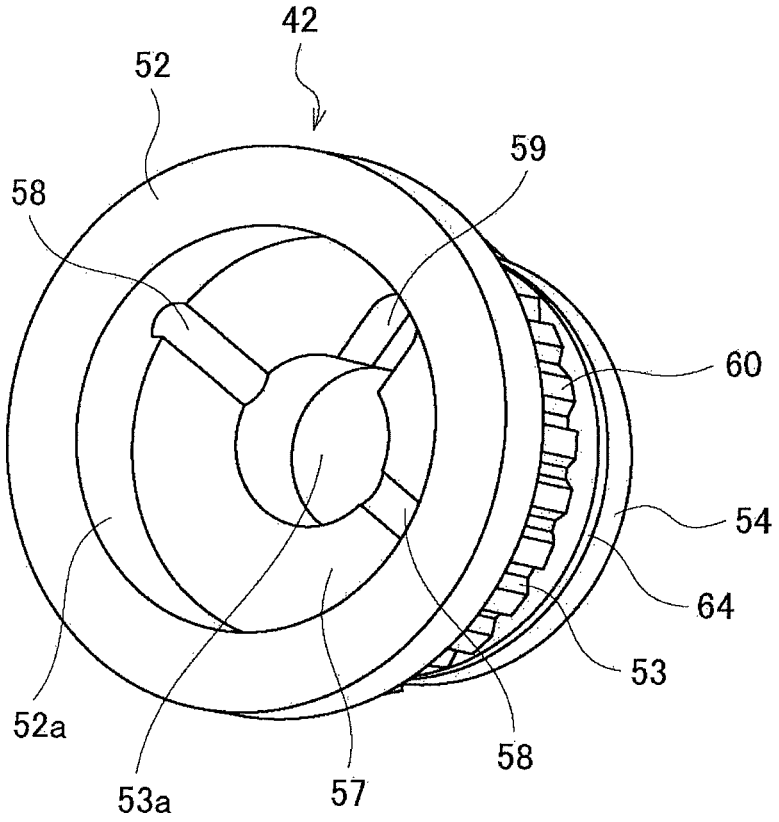
FIG. 4 is a perspective view showing a holder of the camshaft phase varying device in the valve gear for the engine according to the embodiment of the invention.
Figure 5:
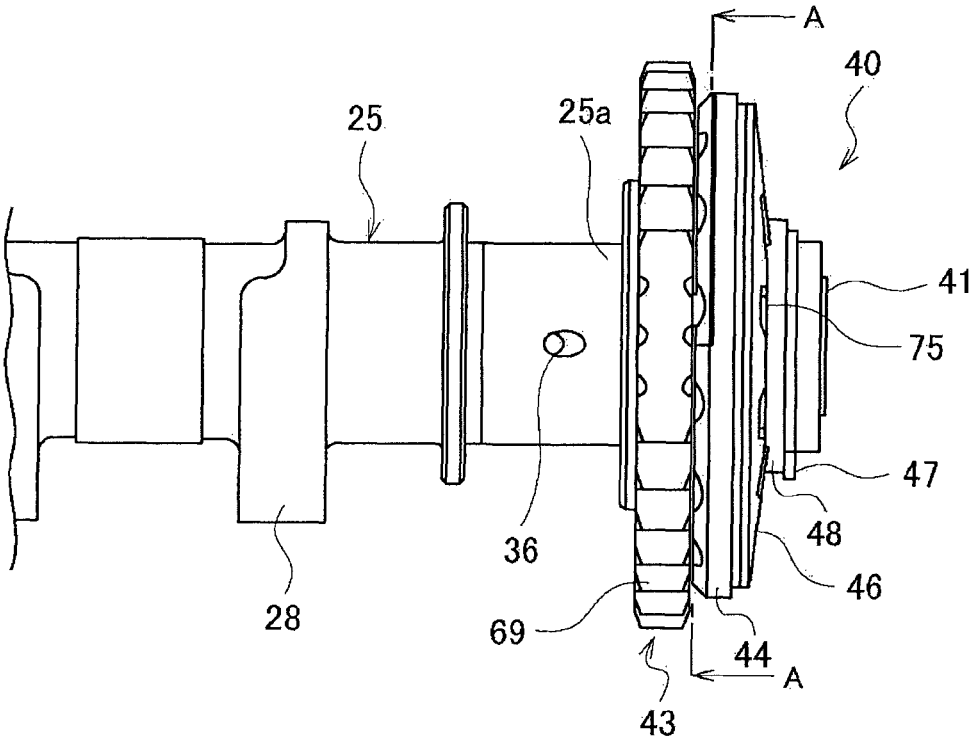
FIG. 5 is a side view showing the camshaft phase varying device in the valve gear for the engine according to the embodiment of the invention.
Figure 6:
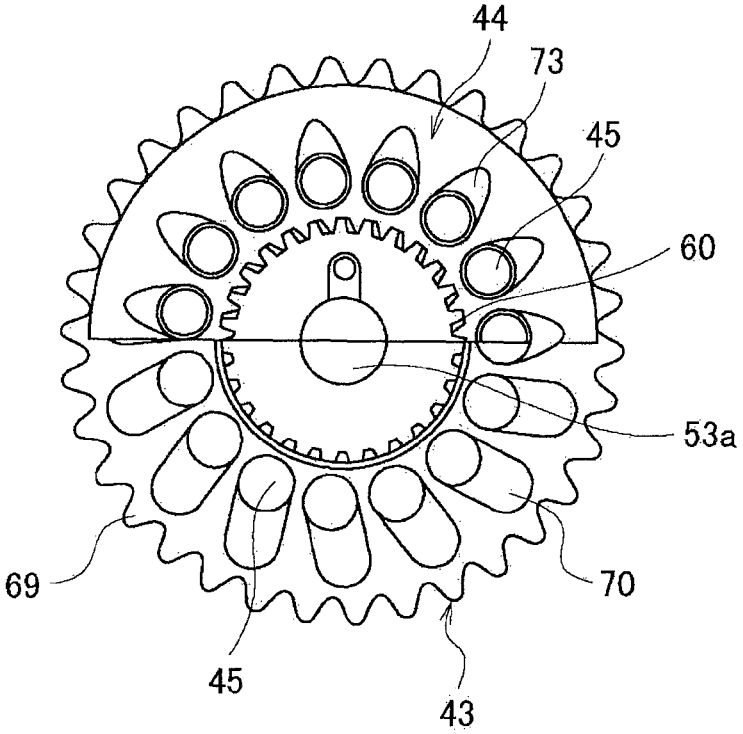
FIG. 6 is a sectional view taken on line A-A in FIG. 5.
Figure 7:
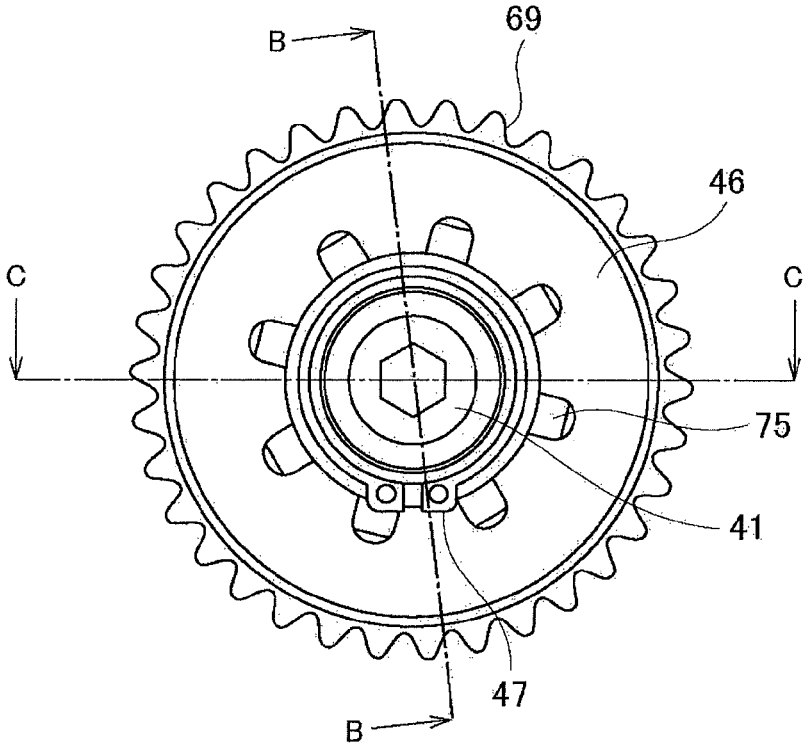
FIG. 7 is a front view showing the camshaft phase varying device in the valve gear for the engine according to the embodiment of the invention.
Figure 8:
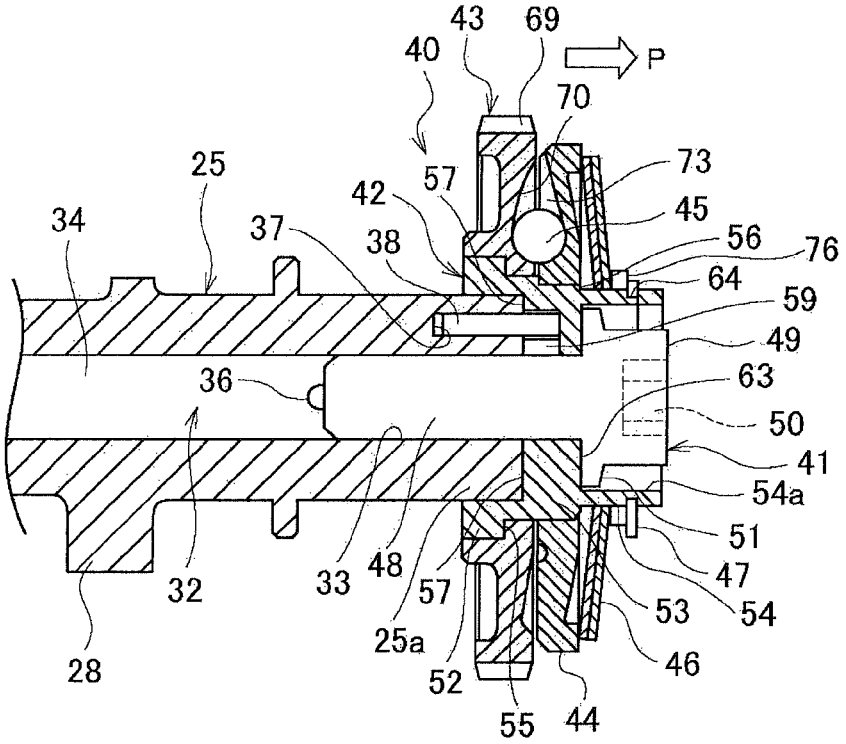
FIG. 8 is a sectional view taken on line B-B in FIG. 7.
Figure 9:
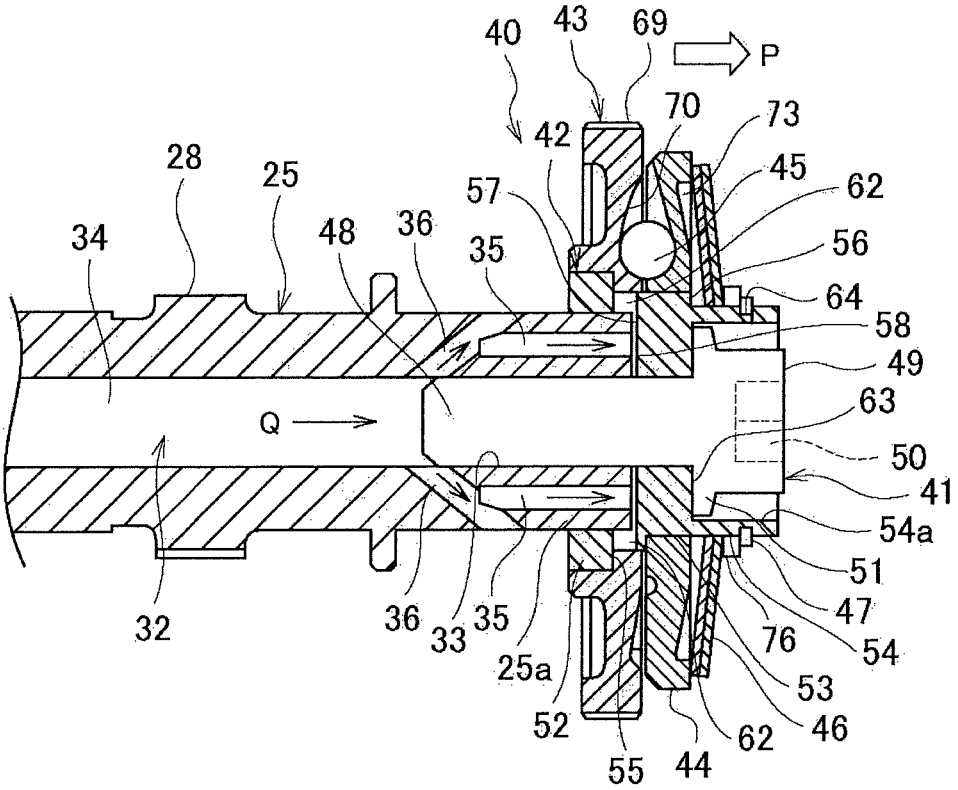
FIG. 9 is a sectional view taken on line C-C in FIG. 7.

Next, the camshaft phase varying device 40 in the embodiment of the invention will be described in detail with reference to FIGS. 2 to 9. Incidentally, in the following description, a case in which the camshaft phase varying device 40 is placed on the intake-side camshaft 25 will be described by way of example. Here, FIG. 2 is a perspective view showing the camshaft phase varying device 40. FIG. 3 is an exploded perspective view showing the camshaft phase varying device 40. FIG. 4 is a perspective view showing a holder of the camshaft phase varying device 40. FIG. 5 is a side view showing the camshaft phase varying device 40. FIG. 6 is a sectional view taken on line A-A in FIG. 5. FIG. 7 is a front view showing the camshaft phase varying device 40. FIG. 8 is a sectional view taken on line B-B in FIG. 7. FIG. 9 is a sectional view taken on line C-C in FIG. 7.

The camshaft phase varying device 40 has a configuration in which a holder 42 is designed to be removably attached to an axial end 25*a* of the intake-side camshaft 25 through a bolt 41, and a driven member 43, a guide member 44, centrifugal weights 45, urging members 46 and a circlip 47 are retained in the holder 42. The guide member 44 is provided to be opposed to the driven member 43. The centrifugal weights 45 are put between the driven member 43 and the guide member 44. The urging members 46 urge the driven member 43 and the guide member 44 so as to make them close to each other.

As shown in FIG. 8 and FIG. 9, a columnar cavity portion 32 is formed axially inside the intake-side camshaft 25, and a threaded hole 33 is formed in an axial end portion of the cavity portion 32 so that the bolt 41 can be inserted and screwed down to the threaded hole 33. The other part of the cavity portion 32 than the threaded hole 33 is used as a main oil passage 34.

In the axial end 25*a* of the intake-side camshaft 25, two columnar subsidiary oil passages 35 are formed axially in symmetric positions with respect to the threaded hole 33. The subsidiary oil passages 35 communicate with the main oil passage 34 through two connection holes 36 formed obliquely from a distal end of the main oil passage 34 toward an outer circumferential portion of the same. In addition, in the axial end 25*a* of the intake-side camshaft 25, a pin hole 37 is formed on the axially outer side of the threaded hole 33 so as to extend in parallel with the subsidiary oil passages 35. A knock pin 38 can be inserted into the pin hole 37.

The bolt 41 has a screw portion 48 and a head portion 49. The screw portion 48 is formed so that the screw portion 48 can be screwed and inserted into the threaded hole 33. The diameter of the head portion 49 is larger than that of the screw portion 48. A hexagonal groove 50 is formed on the distal end side of the head portion 49, and a collar portion 51 is formed on the base end side of the head portion 49.

As shown in FIG. 2, FIG. 3, FIG. 8 and FIG. 9, the holder 42 is, for example, made of carbon steel or the like, and has a configuration in which a large diameter portion 52, a middle diameter portion 53 and a small diameter portion 54 having cylindrical shapes different in outer diameter are provided sequentially and continuously. In the outer circumferential surface of the holder 42, a first outer circumferential step portion 55 is formed between the large diameter portion 52 and the middle diameter portion 53, and a second outer circumferential step portion 56 is formed between the middle diameter portion 53 and the small diameter portion 54.

The large diameter portion 52 has a flat cylindrical shape. The axial end 25*a* of the intake-side camshaft 25 can be fitted into an axial hole 52*a* of the large diameter portion 52.

The middle diameter portion 53 has a cylindrical shape smaller in both outer diameter and inner diameter than the large diameter portion 52. The screw portion 48 of the bolt 41 can be inserted into an axial hole 53*a* of the middle diameter portion 53. A first inner circumferential step portion 57 is formed on the inner circumferential side between the large diameter portion 52 and the middle diameter portion 53. The axial end 25*a* of the intake-side camshaft 25 fitted into the large diameter portion 52 can abut against the first inner circumferential step portion 57. As apparently shown in FIG. 4, two narrow grooves 58 are formed radially in the first inner circumferential step portion 57 so as to put the axial hole 53*a* between the two narrow grooves 58. In addition, a long groove 59 is formed radially and perpendicularly to each narrow groove 58.

A spline key 60 is formed in the outer circumferential surface of the middle diameter portion 53 so as to extend axially from the second outer circumferential step portion 56. A circumferential surface 61 is formed like a belt all over the circumference between the spline key 60 and the first outer circumferential step portion 55. In the circumferential surface 61, two oil supply paths 62 are provided in positions where the oil supply paths 62 extend radially and face each other across the center line of the middle diameter portion 53. The oil supply paths 62 are formed to communicate with the subsidiary oil passages 35 respectively, and formed to be so narrow that the passage sectional area (sectional area perpendicular to the flowing direction of oil) of each oil supply path 62 is smaller than that of each subsidiary oil passage 35.

The small diameter portion 54 has a cylindrical shape smaller in outer diameter and larger in inner diameter than the middle diameter portion 53. The head portion 49 of the bolt 41 can be fitted into an axial hole 54*a* of the small diameter portion 54. A second inner circumferential step portion 63 is formed on the inner circumferential side between the middle diameter portion 53 and the small diameter portion 54. The collar portion 51 of the head portion 49 of the bolt 41 can abut against the second inner circumferential step portion 63. In addition, a slit groove 64 is formed all over the outer circumferential surface of the small diameter portion 54.

As apparently shown in FIG. 3, the driven member 43 is formed out of a doughnut-shaped plate-like member and placed over the large diameter portion 52 of the holder 42 and the circumferential surface 61 of the middle diameter portion 53 of the same. The driven member 43 has a circular center hole 65. The center hole 65 includes a first fitting hole 66 to which the large diameter portion 52 of the holder 42 can be fitted and a second fitting hole 67 to which the circumferential surface 61 of the middle diameter portion 53 can be fitted. A step portion 68 is formed between the first fitting hole 66 and the second fitting hole 67. The step portion 68 can abut against the first outer circumferential step portion 55.

An intake-side cam driven sprocket 69 is formed in the outer circumferential surface of the driven member 43. The cam chain 27 is wound on the intake-side cam driven sprocket 69 and the cam drive sprocket 24 of the crankshaft 16. Thus, the rotation of the crankshaft 16 is transmitted to the driven member 43 through the cam chain 27 so that the driven member 43 can have the same rotational phase as the crankshaft 16.

A plurality of oval guide grooves 70 are formed radially in a surface of the driven member 43 facing the guide member 44. The guide grooves 70 are to guide the centrifugal weights 45. Each guide groove 70 is formed to have a constant groove depth and to be inclined circumferentially to one side at a predetermined angle with respect to the radial direction of the driven member 43 (see the lower half of FIG. 6).

The guide member 44 is formed out of a doughnut-shaped plate-like member smaller in diameter than the driven member 43. The guide member 44 is placed on the spline key 60 of the middle diameter portion 53 of the holder 42. The guide member 44 has a circular center hole 71. A spline groove 72 that can be engaged with the spline key 60 is formed axially in the inner circumferential surface of the center hole 71.

Correspondingly to the guide grooves 70 of the driven member 43, a plurality of guide grooves 73 are formed radially in a surface of the guide member 44 facing the driven member 43. The guide grooves 73 are to guide the centrifugal weights 45. Each guide groove 73 is formed to extend in the radial direction of the guide member 44. Each guide groove 73 is provided with a slope whose depth is smaller as it goes to the radially outer side of the guide member 44. The slope is formed to be steeper as it goes to the radially outer side of the guide member 44. Due to the slopes of the guide members 73, the guide grooves 70 of the driven member 43 and the guide grooves 73 of the guide member 44 are designed so that their groove bottom portions can approach each other as they go to the radially outer side.

The centrifugal weights 45 are formed out of a material large in specific gravity, such as steel or tungsten. Each centrifugal weight 45 has a ball-like shape. The centrifugal weights 45 are retained between the guide grooves 70 of the driven member 43 and the guide grooves 73 of the guide member 44 respectively. The number of the centrifugal weights 45 is the same as the number of the guide grooves 70 and the number of guide grooves 73.

The urging members 46 consist of two disc springs each having a through hole 74 at the center. The urging members 46 put on top of each other is placed between the second outer circumferential step portion 56 of the holder 42 and the slit groove 64 of the small diameter portion 54 of the same. A plurality of notch portions 75 are formed radially around the through holes 74 of the urging members 46 so as to extend to the radially outer side. Incidentally, the urging members 46 may consist of any other members such as corrugated springs or coil springs than the disc springs if the members can urge the driven member 43 and the guide member 44 so as to make them close to each other.

The circlip 47 has an annular shape. The circlip 47 is placed in the slit groove 64 of the small diameter portion 54 of the holder 42. An annular shim 76 is put between one of the urging members 46 and the circlip 47. The shim 76 can abut against the places where the notch portions 75 are formed around the through hole 74 of the urging member 46.

Next, description will be made about the procedure in which the camshaft phase varying device 40 configured thus is installed on the intake-side camshaft 25.

First, the holder 42 is inserted into the center hole 65 of the driven member 43 from the small diameter portion 54 side. Then the step portion 68 of the driven member 43 is brought into contact with the first outer circumferential step portion 55 of the holder 42, and the driven member 43 is placed over the large diameter portion 52 of the holder 42 and the circumferential surface 61 of the middle diameter portion 53 of the same.

Next, the holder 42 is inserted into the center hole 71 of the guide member 44 in the state where the centrifugal weights 45 have been received in the guide grooves 70 of the driven member 43 respectively. The spline key 60 of the holder 42 is engaged with the spline groove 72 of the guide member 44. Then the guide member 44 is put on top of the driven member 43, and the centrifugal weights 45 are retained between the guide grooves 70 of the driven member 43 and the guide grooves 73 of the guide member 44 respectively.

Next, the small diameter portion 54 of the holder 42 is inserted into the through holes 74 of the two urging members 46 that have been put on top of each other. Then the outer circumferential portion of one of the urging members 46 is brought into the outer circumferential portion of the guide member 44 so that the urging members 46 can be placed between the second outer circumferential step portion 56 of the holder 42 and the slit groove 64 of the small diameter portion 54 of the same.

Next, the small diameter portion 54 of the holder 42 is inserted into the shim 76, and the circlip 47 is then fitted into the slit groove 64 of the small diameter portion 54 so that the urging members 46 can be pressed axially.

As a result, the driven member 43 and the guide member 44 are pressed axially by the urging members 46, so that the driven member 43 and the guide member 44 can be installed on the holder 42 in the state where the centrifugal weights 45 have been retained between the guide grooves 70 and 73 of the two members respectively.

Next, the axial end 25*a* of the intake-side camshaft 25 is fitted into the axial hole 52*a* of the large diameter portion 52 of the holder 42 retaining the driven member 43, the guide member 44, the centrifugal weights 45, the urging members 46 and the circlip 47, which are constituent members of the camshaft phase varying device 40 as described above. Thus, the axial end 25*a* of the intake-side camshaft 25 is brought into contact with the first inner circumferential step portion 57. At this time, as shown in FIG. 3, one end of the knock pin 38 the other end of which has been inserted into the pinhole 37 of the intake-side camshaft 25 is inserted into the long groove 59 of the holder 42. As a result, the rotational movement between the intake-side camshaft 25 and the holder 42 is restricted. In addition, the two subsidiary oil passages 35 formed on the intake-side camshaft 25 side and the two narrow grooves 58 formed on the holder 42 side are positioned to communicate each other respectively. Thus, oil passages are formed to flow from the main oil passage 34 via the two connection holes 36 and the subsidiary oil passages 35 and then reach the two oil supply paths 62 from the long grooves 59.

Next, in the aforementioned fitting state, the screw portion 48 of the bolt 41 is inserted from the axial hole 54*a* side of the small diameter portion 54 of the holder 42. A tool (not shown) is attached to the hexagonal groove 50 to screw and insert the screw portion 48 into the threaded hole 33 of the intake-side camshaft 25 so that the collar portion 51 can abut against the second inner circumferential step portion 63. Thus, the holder 42 retaining the respective constituent components of the camshaft phase varying device 40 is fixed to the axial end 25*a* of the intake-side camshaft 25. The driven member 43 is installed on the intake-side camshaft 25 so that the driven member 43 cannot be rotationally displaced relatively to the intake-side camshaft 25 but can be axially displaced relatively to the same. The guide member 44 is provided rotatably together with the intake-side camshaft 25 and installed so that the guide member 44 can be displaced rotationally and axially relatively to the driven member 43.

Next, the operation of the valve gear 23 of the engine 10 according to the embodiment of the invention will be described.

The centrifugal force acting on the centrifugal weights 45 is small when the engine 10 runs in a low speed rotation range. Accordingly, as shown in FIG. 8 and FIG. 9, the centrifugal weights 45 stay in their initial positions at the radially inner ends of the guide grooves 70 and 73 due to the effect of the slopes of the guide grooves 73 of the guide member 44 and the urging force of the urging members 46. Thus, the intake-side camshaft 25 has the same rotational phase as the crank shaft 16 so that intake cams 28 formed integrally with the intake-side camshaft 25 can drive the intake valves 21 with the same phases as when they were installed. As a result, the intake valves 21 and the exhaust valves 22 are driven at low/middle speed valve timings with a large amount of valve overlap so that middle speed toque can be improved.

On the other hand, when the engine 10 reaches a high speed rotation range, the centrifugal force acting on the centrifugal weights 45 increases. Thus, the centrifugal weights 45 move to the radially outer side inside the guide grooves 70 of the driven member 43 and the guide grooves 73 of the guide member 44. As a result, the guide member 44 moves to the axially outer side (the direction of the arrow P in FIG. 8 and FIG. 9) of the intake-side camshaft 25 and against the urging force of the urging members 46 due to the effect of the slopes of the guide grooves 73. At this time, the guide grooves 70 of the driven member 43 are inclined circumferentially to one side with respect to the radial direction. Therefore, the guide member 44 rotates relatively to the driven member 43 and along the slopes of the guide grooves 70 (oppositely to the rotating direction of the intake-side camshaft 25).

As a result, the rotational phase of the intake-side camshaft 25 changes relatively to that of the crankshaft 16. On this occasion, the phase of the intake-side camshaft 25 changes in an opposite direction (lag side) to the rotating direction of the intake-side camshaft 25. Thus, the intake cams 28 formed integrally with the intake-side camshaft 25 drive the intake valves 21 with phases changed to the lag side relatively to their phases at the time when they were installed. As a result, the intake valves 21 and the exhaust valves 22 are driven at high speed valve timings with a small amount of valve overlap so that the engine 10 can be improved as to output power and fuel consumption and the discharge of harmful substances can be suppressed.

When the engine speed of the engine 10 decreases after that, the centrifugal force acting on the centrifugal weights 45 becomes low. Thus, the urging force of the urging members 46 surpasses the force with which the guide member 44 is moved to the axially outer side (the direction of the arrow P in FIG. 8 and FIG. 9) of the intake-side camshaft 25 by the centrifugal force, so that the guide member 44 can move toward the driven member 43 by the effect of the urging force of the urging members 46. As a result, the centrifugal weights 45 move to the radially inner side inside the guide grooves 70 and 73 so that the guide member 44 and the centrifugal weights 45 can be restored to their initial positions shown in FIG. 8 and FIG. 9. Due to the restoration of the centrifugal weights 45 to their initial positions, the guide member 44 rotates to advance side relatively to the driven member 43 so that the phase of the intake-side camshaft 25 can be changed to the advance side relatively to that of the crankshaft 16. As a result, the intake valves 21 and the exhaust valves 22 are driven at low/middle speed valve timings with a large amount of valve overlap so that the middle speed torque can be improved, as described above.

In addition, during the operation of the valve gear 23 of the engine 10, as described above, engine oil introduced into oil grooves (not shown) of the bearing portion 30 and the cam housing 31 flows into the main oil passage 34 as shown by the arrow Q in FIG. 9, passes through the two connection holes 36 and the subsidiary oil passages 35 and reaches the two oil supply paths 62 from the narrow grooves 58. The engine oil is supplied to the camshaft phase varying device 40 (particularly to the sliding surfaces between the guide member 44 and the holder 42, the centrifugal weights 45 inside the guide grooves 70 and 73, etc.) so as to lubricate the camshaft phase varying device 40. After that, the engine oil is discharged to the outside of the camshaft phase varying device 40 through oil discharge holes (not shown) formed in the guide grooves 70 of the driven member 43.

According to the valve gear 23 of the engine 10 according to the embodiment of the invention, as described above, the holder 42 can be installed on the intake-side camshaft 25 after the constituent components of the camshaft phase varying device 40 have been held in the holder 42. Accordingly, the operations of the constituent components of the camshaft phase varying device 40 can be confirmed and adjusted in a stage in which the holder 42 holding the constituent components has not yet been installed on the intake-side camshaft 25. It is therefore possible to perform such a work easily and surely. In addition, if some problem is found in a constituent component as a single body in this stage, the component can be replaced as a single body easily and rapidly. It is possible to prevent a variation from occurring in the performance such as engine speed for changeover, durability, reproducibility, etc. due to a variation in frictional force between components touching each other. Thus, the performance can be guaranteed easily.

In addition, if there occurs necessity to perform the work of confirming and adjusting the operations after the holder 42 holding the constituent components of the camshaft phase varying device 40 has been installed on the intake-side camshaft 25, the holder 42 can be removed from and attached to the intake-side camshaft 25 easily by the single bolt 41. Thus, the work can be made simple and easy.

In addition, according to the valve gear 23 of the engine 10 according to the aforementioned embodiment of the invention, the spline key 60 is formed on the holder 42 different from the intake-side camshaft 25 so that the guide member 44 can slide on the spline key 60. Another material high in abrasion resistance than the material of the intake-side camshaft 25 can be used for the spline key 60. Thus, the durability can be improved.

Further, the holder 42 can be attached to the axial end 25*a* of the intake-side camshaft 25 by the bolt 41 or the knock pin 38 so that the holder 42 cannot rotate. Thus, the valve gear 23 or the camshaft phase varying device 40 can be provided with their predetermined performance surely.

Further, the main oil passage 34 and the subsidiary oil passages 35 of the intake-side camshaft 25 communicate with the oil supply paths 62 of the holder 42. Engine oil supplied to the intake-side camshaft 25 can be supplied stably to the sliding surfaces between the guide member 44 and the holder 42 of the camshaft phase varying device 40, the centrifugal weights 45 inside the guide grooves 70 and 73, etc. Thus, the camshaft phase varying device 40 can be lubricated. It is therefore possible to operate the camshaft phase varying device 40 stably and it is also possible to improve the abrasion resistance of each constituent component of the camshaft phase varying device 40.

Further, according to the valve gear 23 of the engine 10 according to the aforementioned embodiment of the invention, the valve timings of the intake valves 21 can be changed surely by a simple structure. It is possible to stabilize the operation characteristics as to the change of the valve timings to thereby improve reliability and responsibility.

Incidentally, the case where the camshaft phase varying device 40 is installed on the intake-side camshaft 25 has been described in the aforementioned embodiment of the invention. However, this is not to limit the invention to the case. That is, for example, the configuration may be arranged as follows. The camshaft phase varying device 40 may be installed on the exhaust-side camshaft 26 so that the rotational phase of the exhaust-side camshaft 26 can be changed to the advance side relatively to that of the crankshaft 16 at the time of high speed rotation of the engine to thereby change the valve timings of the intake valves 21 and the exhaust valves 22 to high speed valve timings with a small amount of valve overlap. Alternatively, camshaft phase varying devices 40 may be installed on both the intake-side camshaft 25 and the exhaust-side camshaft 26 so that the valve timings of the intake valves 21 and the exhaust valves 22 can be changed to high speed valve timings with a small amount of valve overlap at the time of high speed rotation of the engine.

Incidentally, a preferred mode for carrying out a valve gear for an engine according to the invention has been described in the aforementioned description of the embodiment of the invention. Therefore, a variety of technically desirable limitations may be added to the description. However, the technical scope of the invention is not limited to those forms unless otherwise stated. That is, constituent elements in the aforementioned embodiment of the invention may be replaced by existing constituent elements or the like and may be combined with other existing constituent elements. Various variations including such replacement and such combination can be performed. The contents of the invention stated in Claims are not limited by the description of the aforementioned embodiment of the invention.

What is claimed is:

1. A valve gear for an engine, comprising:

a camshaft phase varying device by which a rotational phase of a camshaft for opening/closing valves of the engine can be changed relatively to a rotational phase of a crankshaft; and a holder that is removably attached to the camshaft in a state where the holder holds constituent components of the camshaft phase varying device, wherein the constituent components of the camshaft phase varying device comprises:

a driven member that cannot be displaced axially relatively to the camshaft but can be displaced rotationally relatively to the camshaft, a guide member that is provided rotatably together with the camshaft so that the guide member can be displaced rotationally and axially relatively to the driven member, a centrifugal weight that is disposed between the driven member and the guide member, and an urging member that urges the driven member and the guide member so as to make the driven member and the guide member close to each other; and wherein the holder is a single continuous member attached to the camshaft so as to surround one end side of the camshaft, and the driven member, the guide member, the centrifugal weight and the urging member are provided an outer side of the holder as opposed to an inner side of the holder at which the camshaft is positioned.

2. The valve gear for an engine according to claim 1, wherein a spline key is provided in the holder, and the guide member is held in the holder so that the guide member can move axially along the spline key.

3. The valve gear for an engine according to claim 2, wherein the holder is attached to an axial end of the camshaft so that the holder cannot rotate relative to the camshaft.

4. The valve gear for an engine according to claim 2, wherein an oil passage is provided inside the camshaft, and an oil supply path to the constituent components of the camshaft phase varying device is formed in the holder so as to communicate with the oil passage.

5. The valve gear for an engine according to claim 4, wherein the oil supply path is formed with a smaller passage sectional area than that of the oil passage and in a position where oil can be supplied to the spline key provided in the holder.

6. The valve gear for an engine according to claim 1, wherein the holder is attached to an axial end of the camshaft so that the holder cannot rotate relative to the camshaft.

7. The valve gear for an engine according to claim 6, wherein an oil passage is provided inside the camshaft, and an oil supply path to the constituent components of the camshaft phase varying device is formed in the holder so as to communicate with the oil passage.

8. The valve gear for an engine according to claim 7, wherein the oil supply path is formed with a smaller passage sectional area than that of the oil passage and in a position where oil can be supplied to a spline key provided in the holder.

9. The valve gear for an engine according to claim 1, wherein an oil passage is provided inside the camshaft, and an oil supply path to the constituent components of the camshaft phase varying device is formed in the holder so as to communicate with the oil passage.

10. The valve gear for an engine according to claim 9, wherein the oil supply path is formed with a smaller passage sectional area than that of the oil passage and in a position where oil can be supplied to a spline key provided in the holder.

* * * * *